United States Patent [19]

van Laar et al.

[11] 4,332,554

[45] Jun. 1, 1982

[54] SHAFT FURNACE HAVING COOLING PLATES

[75] Inventors: Jacobus van Laar, Santpoort; Jacob Felthuis, Oudorp; Wilhelmus A. J. Kastelic, Ijmuiden, all of Netherlands

[73] Assignee: Hoogovens Ijmuiden B.V., Ijmuiden, Netherlands

[21] Appl. No.: 161,655

[22] Filed: Jun. 20, 1980

[30] Foreign Application Priority Data

Jun. 21, 1979 [NL] Netherlands ..... 7904848
Nov. 13, 1979 [NL] Netherlands ..... 790820

[51] Int. Cl.[3] ..... F27D 1/12; C21B 7/10

[52] U.S. Cl. ..... 432/233; 266/194; 432/238

[58] Field of Search ..... 432/233, 238, 237; 110/336, 180; 266/193, 194, 241

[56] References Cited

U.S. PATENT DOCUMENTS 2,240,361 4/1941 Willetts ..... 432/238
3,593,975 7/1971 White, Jr. ..... 266/194
3,953,007 4/1976 van Laar ..... 266/193

FOREIGN PATENT DOCUMENTS 719137 3/1942 Fed. Rep. of Germany ..... 432/233

*Primary Examiner*—John J. Camby
*Attorney, Agent, or Firm*—Jon M. Lewis

[57] ABSTRACT

A shaft furnace has a refractory lining within its armour and cooling plates located in recesses in the lining. In order to make it easier to remove and replace the cooling plates and to improve heat transfer, it is now proposed to construct the recess walls of special shaped members so that the recess retains its shape. The shaped members include elongate side members, a cover member resting on the elongate members, a bottom member below the elongate members and a front member between the front edge of the cooling plate and the furnace interior. Copper sheets may be provided between the cooling plate and these shaped members.

13 Claims, 3 Drawing Figures

SHAFT FURNACE HAVING COOLING PLATES

BACKGROUND OF THE INVENTION

1. Field of the Invention

The invention relates to a shaft furnace having a furnace armour, a refractory lining and cooling plates inserted through the furnace armour into recesses in the lining.

2. Description of the Prior Art

It is conventional, in shaft furnaces of this type, to lay the bricks of the brickwork lining in bond around the cooling plates and to fill the spaces remaining between the bricks and the generally tapering cooling plate with a refractory ramming mass.

In shaft furnace constructions, it is of great importance that there should be good thermal contact between the cooling plates and the refractory construction of the lining, so as to achieve good cooling of the refractory construction. Attempts have been made to improve the known brickwork construction in this sense. To this end, it has been sought to make the layer thickness of the ramming mass between the cooling plate and the refractory construction as small as possible, or even to omit this ramming mass entirely, since the thermal conductivity through this ramming mass is usually small.

SUMMARY OF THE INVENTION

It is an object of the invention to improve heat conduction between the cooling plates and the refractory lining of a shaft furnace.

It is furthermore an object of the invention to provide a construction whereby cooling plates can be exchanged simply, without radical working of the refractory lining construction being necessary. It has in fact been realized that, in known constructions the recess which is left on extraction of a cooling plate retains its shape inadequately to permit the positioning of a fresh cooling plate without considerable problems.

The present invention now proposes that the recess for the cooling plate is defined by a plurality of special shaped elements which retain the shape of the recess when the cooling plate is removed, and at the same time enable better thermal contact between the cooling plate and the refractory lining.

In particular, according to the invention, each recess is at least partly bounded by a plurality of shaped refractory members which serve to maintain the shape of the recess, said members comprising at each of two sides of the recess, an elongate member which is disposed with its longitudinal direction substantially radial with respect to the furnace and, as the roof of the recess, a cover member which is supported on the said elongate members.

Each shaped member may be in one or more parts. The cover member may be made in one piece or in several parts situated radially (with respect to the furnace interior) behind one another, so that the upper surface of the cooling plate is not in contact with any radially extending seam between adjacent refractory bricks. The direct surface contact of the cooling plate with the recess wall can be further improved if the cover member is also supported by a front member which is in one-piece or several pieces and is adjacent the front edge of the cooling plate.

Preferably also according to the invention the bottom of the recess is formed by a bottom member disposed under the elongate members and the front member.

The elongate members can be subdivided longitudinally or transversely. It is even conceivable that they are composed of contrareacting wedges, in which case the width of the recess can be varied by moving these wedges along one another. The simplest and best thermally conducting construction, however is that each elongate member is made in one piece.

In order to make the extraction and replacement of cooling plates easier, the plates are usually of tapering shape towards the furnace interior, in respect of both their height and their width. Although, if the opposite walls of the recess are parallel to each other, it is possible in such a case to fill gaps between the walls of the recess and the surface of the cooling plate with ramming mass, it is clearly preferable in the invention to design the cover member, the front member and the elongate members of tapering height, adapted in fact to the tapering shape of the cooling plate. Thereby, both assembly and disassembly of the cooling plates are made simple, and furthermore very close and satisfactory thermal contact between cooling plate and the recess surface may be achieved.

In a similar manner, the bottom member the cover member, the front member and the elongate members can have their widths varying in dependence on the taper of the width of the cooling plate. In fact the lateral edges of the cooling plate may extend about radially of the furnace wall.

It is preferred, to achieve further improvement of thermal contact, to subject all these shaped construction members to a fine surface machining, e.g. grinding.

It has been found that optimum results can be achieved with the construction of the invention if the shaped members which form the recess are made of material of high thermal conductivity, such as carbon. In particular, graphite is here especially suitable, due to its extremely good machinability and its high thermal conductivity coefficient. In this manner, there is achieved not only good contact and good heat transfer between cooling plate and recess surface, but also good heat flow towards the contact surface.

It has been found that the construction of the invention can not only result in a notable improvement in the cooling of the refractory lining, thereby affording also a notable prolongation of the working life of the lining, but also that the extraction and replacement of cooling plates can be considerably simplified and the time required for this can be considerably shortened.

In particular these benefits can be obtained, if between the cooling plate and at least some of the adjacent refractory shaped members, sheets of metal of high thermal conductivity, preferably copper, are disposed. These sheets should preferably have a thickness of less than 3.2 mm and more preferably about 0.5 mm. During exchange of a cooling plate, movement or deformation of the recess and dimensional differences between cooling plates can be neutralized by metal sheets of different, suitably chosen thicknesses.

BRIEF INTRODUCTION OF THE DRAWINGS

An embodiment of the invention will now be described by way of non-limitative example with reference to the accompanying drawings, in which:

FIG. 1 shows, in cross-section, a portion of the shell construction of a shaft furnace according to the invention, FIG. 2 shows a longitudinal section through this construction on the line II—II in FIG. 1, and FIG. 3 shows a further cross-section on the line III—III in FIG. 1.

DESCRIPTION OF THE PREFERRED EMBODIMENT

Figure 1:
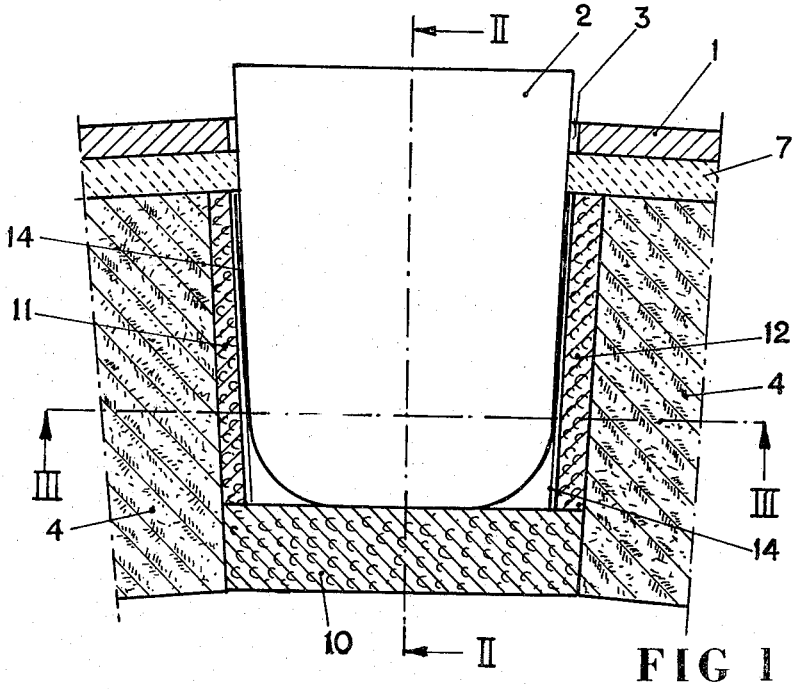
Figure 3:
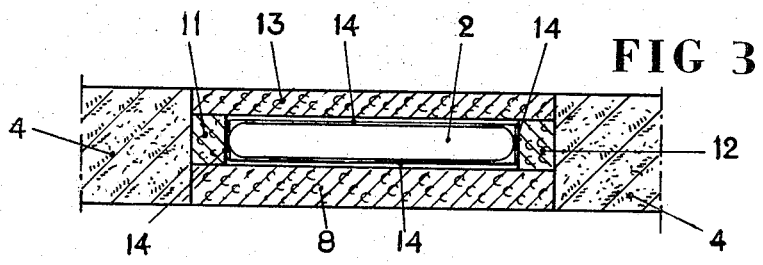

Referring to the drawing, there is shown a portion of the plate armour 1 of a blast furnace. A cooling plate 2 extends through an aperture 3 in the furnace armour. The cooling plate 2 is of conventional construction and comprises a machined hollow copper casting, connected to a water circulation system (not shown). In the figures, the cooling plate is indicated purely diagrammatically with only its outer surface indicated where it extends into the furnace. It is to be understood that a blast furnace has a number of such cooling plates spaced vertically and around the furnace.

Figure 2:
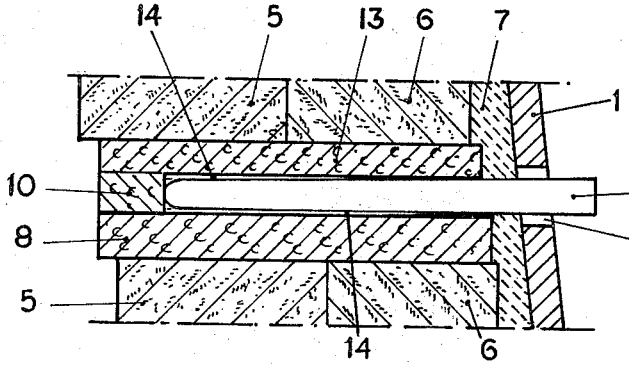

The width of the cooling plate tapers towards the interior of the furnace, this taper being adapted to the diameter of the furnace armour, i.e. so that when it is in its final position the lateral edges of the plate extend radially of the furnace. Also in respect of its thickness, the cooling plate has a taper, as indicated in FIG. 2. Thus a defective cooling plate can be extracted simply by withdrawing it and can be easily replaced by a fresh cooling plate.

At both sides, the cooling plate is located between the bricks of the normal lining 4 of the furnace wall. The same applies to the normal lining layers 5 above and below the cooling plate. However, the construction of the invention differs from known constructions in that the normal lining structure 4 and 5 is interrupted over such a large volume that the recess which receives the cooling plate 2 is separately constructed by means of a plurality of shaped refractory members, the recess thus not being bounded by the normal bricks of the lining. These shaped members bounding the recess are a bottom plate 8, a front member 10, lateral elongate members 11 and 12, and a cover plate 13. These members are ground graphite blocks.

The members 8,10,11,12,13 are in this embodiment each in one-piece. These members also taper in their width and in their height in conformity with the tapers of the cooling plate, so that generally speaking their surfaces are parallel to the respective opposed surfaces of the cooling plate. The front member 10 lies between the front edge of the cooling plate and its innermost surface is part of the interior surface of the furnace lining. The cover plate 13 rests on the lateral members 11,12 and the front member 10. The bottom plate 8 extends beneath the lateral members 11,12 and the front member 10.

Gaps, if any, between the cooling plate on the one hand and the elongate members 11,12, the cover plate 13 and the bottom plate 8 on the other, are filled with copper sheets 14, in order to guarantee good thermal contact between the cooling plate and its surroundings. It has been found that good filling of these gaps can be achieved with copper plates 14 of 0.5 mm thickness. On inserting a fresh cooling plate, dimensional variations in the recess can be neutralized by copper plates of different thicknesses.

Between the brickwork 4,5 and the furnace armour 1, there is a refractory filling mass 7.

There is thus obtained a recess which is dimensionally stable even when the coding plate is removed and which is bounded by shaped members which are adapted to provide good thermal contact with the cooling plate and are themselves of high thermal conductivity. The metal sheets 14 may be used to improve thermal contact.

What is claimed is:

1. A shaft furnace having
   (a) a furnace armour,
   (b) a refractory inner lining inside the armour having recesses therein
   (c) a plurality of cooling plates inserted through the armour into said recesses in the lining, each said plate having opposite main faces which respectively face upwardly and downwardly, opposite side edges and a front edge which faces towards the interior of the furnace, wherein each said recess is at least partly bounded and defined by a plurality of shaped refractory members which are located in said lining and are adapted to maintain the shape of the recess on removal of the cooling plate, said shaped members comprising, at each of opposite sides of the recess adjacent said side edges of the cooling plate, an elongate member which is disposed with its longitudinal direction substantially parallel to and has a face of generally complementary shape with respect to the respective adjacent said side edge of the cooling plate, and a cover member which is supported on said elongate members extends across and has a face of generally complementary shape with respect to an adjacent surface of said upper main face of the cooling plate so as to provide a roof of the recess.

2. A shaft furnace according to claim 1 wherein the said elongate members are each formed in one piece.

3. A shaft furnace according to claim 1 wherein the said shaped members further include a front member which is located adjacent the said front edge of the cooling plate between the said front edge and the interior of the furnace and has a face which provides a portion of the interior face of the said lining of the furnace, the front member also supporting the said cover member.

4. A shaft furnace according to claim 3 wherein said shaped members further include a bottom member which extends beneath the said elongate members and said front member and beneath the lower main face of the cooling plate so as to provide a base of the recess.

5. A shaft furnace according to either of claims 3 and 4 wherein the cooling plate, as seen in vertical section, tapers towards the interior of the furnace, and the said cover member, the said elongate members and the said front member also taper in dependence on the taper of the cooling plate.

6. A shaft furnace according to any one of claims 1, 3 and 4 wherein each of the said shaped members has been subjected to surface machining.

7. A shaft furnace according to any one of claims 1, 3 and 4 wherein the cooling plate tapers in its width towards the interior of the furnace, and the said shaped members also taper in their widths in dependence on the taper of the cooling plate.

8. A shaft furnace according to claim 1 wherein the said shaped members are made of a material of high thermal conductivity.

9. A shaft furnace according to claim 8 wherein the said shaped members are made of carbon.

10. A shaft furnace according to claim 1 wherein sheets of metal are disposed in intimate relationship between the cooling plate and at least some of the said shaped members, whereby effective thermal contact will be established between said cooling plate and said shaped members.

11. A shaft furnace according to claim 10 wherein the said sheets of metal are copper.

12. A shaft furnace according to either of claims 10 and 11 wherein the said sheets of metal have a thickness of less than 3.2 mm.

13. In a shaft furnace having a furnace armour a refractory inner lining inside the armour and a plurality of cooling plates inserted through the armour into recesses in the lining, with the main faces of each plate facing respectively upwardly and downwardly, opposite side edges and a front edge which faces toward the interior of the furnace, the improvement that each recess is at least partly bounded by a plurality of shaped refractory members which serve to maintain the shape of the recess, said members comprising at each of the two sides of the recess, an elongate member which is disposed with its longitudinal direction substantially radial with respect to the furnace and has a surface of generally complementary shape with respect to an adjacent side edge of said cooling plate and, as the roof of the recess, a cover member which is supported on the said elongate members and has a surface of generally complementary shape with respect to an adjacent surface of said upwardly facing main face of said cooling plate.

* * * * *

UNITED STATES PATENT AND TRADEMARK OFFICE

CERTIFICATE OF CORRECTION

PATENT NO. :4,332,554

DATED :June 1, 1982

INVENTOR(S) :Jacobus van Laar et al

It is certified that error appears in the above-identified patent and that said Letters Patent is hereby corrected as shown below:

On the title page, Item (30) Foreign Application Priority Data, "790820" should read -- 7908280 --.

Signed and Sealed this

*Twenty-first* Day of *December 1982*

[SEAL]

*Attest:*

GERALD J. MOSSINGHOFF

*Attesting Officer*

*Commissioner of Patents and Trademarks*